US011110460B2

(12) United States Patent
Kim et al.

(10) Patent No.: US 11,110,460 B2
(45) Date of Patent: Sep. 7, 2021

(54) INLET/OUTLET STRUCTURE OF MICROFLUIDIC CHIP AND METHOD FOR SEALING SAME

(71) Applicant: NANOBIOSYS INC., Seoul (KR)

(72) Inventors: Sung Woo Kim, Seoul (KR); Seung Min Jeong, Seoul (KR); Jae Young Byun, Bucheon-si (KR)

(73) Assignee: NANOBIOSYS INC., Seoul (KR)

( * ) Notice: Subject to any disclaimer, the term of this patent is extended or adjusted under 35 U.S.C. 154(b) by 374 days.

(21) Appl. No.: 16/326,572

(22) PCT Filed: Aug. 18, 2017

(86) PCT No.: PCT/KR2017/009025

§ 371 (c)(1),
(2) Date: Feb. 19, 2019

(87) PCT Pub. No.: WO2018/034540

PCT Pub. Date: Feb. 22, 2018

(65) Prior Publication Data

US 2019/0224682 A1 Jul. 25, 2019

(30) Foreign Application Priority Data

Aug. 18, 2016 (KR) ..... 10-2016-0104662

(51) Int. Cl.
*B01L 3/00* (2006.01)
*B01L 7/00* (2006.01)

(52) U.S. Cl.
CPC ..... *B01L 3/565* (2013.01); *B01L 3/502707* (2013.01); *B01L 3/502715* (2013.01); (Continued)

(58) Field of Classification Search
CPC ..... B01L 3/565; B01L 3/502707; B01L 3/502715; B01L 2200/0689; B01L 3/5027; B01L 3/00
See application file for complete search history.

(56) References Cited

U.S. PATENT DOCUMENTS

2011/0300570 A1* 12/2011 Khademhosseini ..... B01L 3/50273 435/29

FOREIGN PATENT DOCUMENTS

KR 10-2008-0090410 A 10/2008
KR 10-2010-0099940 A 9/2010
(Continued)

*Primary Examiner* — Brian J. Sines
(74) *Attorney, Agent, or Firm* — Novick, Kim & Lee, PLLC; Sang Ho Lee

(57) ABSTRACT

Provided is a microfluidic chip having an inlet/outlet structure optimized for sealing an inlet/outlet of a microfluidic chip using a UV curable sealing material, a microfluidic chip having the inlet/outlet structure, and a method of sealing the inlet/outlet of the microfluidic chip using a UV curable sealing material. It is possible to provide a semi-permanent seal with less contamination from a fluid sample or a harmful reagent, and the inlet/outlet of the microfluidic chip can be firmly sealed using simple equipment and without high-temperature/high-pressure conditions. By using the inlet/outlet structure of the microfluidic chip and the sealing method thereof, it is possible not only to improve the accuracy and deviation of the reaction result as the generation of bubbles is suppressed even when a predetermined reaction is performed on the microfluidic chip, but also it is possible to apply a fully automated system by eliminating the need for ancillary equipment such as a chip case and minimizing or eliminating manual operations.

18 Claims, 8 Drawing Sheets

(52) U.S. Cl.
CPC ..... *B01L 7/525* (2013.01); *B01L 7/52* (2013.01); *B01L 2200/0684* (2013.01); *B01L 2200/0689* (2013.01); *B01L 2300/08* (2013.01)

(56) References Cited

FOREIGN PATENT DOCUMENTS

| | | | |
|---|---|---|---|
| KR | 10-2010-0103300 | A | 9/2010 |
| KR | 10-2015-0094842 | A | 8/2015 |
| KR | 10-2016-0058302 | A | 5/2016 |
| WO | 2013/043540 | A2 | 3/2013 |

* cited by examiner (a)

(b)

(a)

(b)

(a)

(b)

INLET/OUTLET STRUCTURE OF MICROFLUIDIC CHIP AND METHOD FOR SEALING SAME

TECHNICAL FIELD

The present disclosure provides an inlet/outlet structure of a microfluidic chip, a microfluidic chip having the inlet/outlet structure, and a method of sealing an inlet/outlet of the microfluidic chip. In particular, the present disclosure is related to an inlet/outlet structure of a microfluidic chip that is optimized for sealing the inlet/outlet of a microfluidic chip using a UV curable sealant, a microfluidic chip having the inlet/outlet structure, and a method of sealing the inlet/outlet of the microfluidic chip using the UV curable sealant.

BACKGROUND ART

A microfluidic chip has a function of simultaneously performing various experimental conditions by flowing fluid through a microfluidic channel. In particular, a microchannel is made using a substrate (or a chip material) such as plastic, glass, silicon, etc., and a fluid (e.g., a liquid sample) is moved through such a channel. Thereafter, it may be mixed and reacted in a plurality of chambers in a microfluidic chip. Thus, a microfluidic chip is also called a "lab-on-a-chip" in that the experiments that were conventionally performed in laboratories are performed in a small chip.

Microfluidic chips have not only produced cost and time savings in a variety of fields such as pharmaceuticals, biotechnology, medicine and chemistry, but also can provide high accuracy, efficiency and reliability. For example, the use of microfluidic chips can significantly reduce the amount of expensive reagents used for cell culture, proliferation, and differentiation compared to conventional methods, thereby saving considerable cost. In addition, protein and cell samples can be used in much smaller quantities than conventional methods and can be used for image analysis, reducing sample usage, consumption and analysis time.

However, in the microfluidic chip, the fluid is vaporized and lost due to heat applied to the reaction area during a predetermined reaction, for example, a PCR (polymerase chain reaction) reaction, or the fluid leaks from the microfluidic chip in which the reaction is terminated. In addition, a large number of bubbles are generated due to the vaporization of the fluid due to the high reaction temperature in the reaction area. This generates a problem in that it is difficult not only to precisely measure inside the reaction area, but also the bubbles distort the reaction result and thus impair reliability. In this regard, FIG. 1A shows bubbles generated due to the vaporization of the fluid in the reaction area during the reaction in the conventional PCR chip. When a large number of bubbles are generated in the reaction area, as shown in FIG. 1B, the reaction results are irregular or a large amount of noise is generated.

To solve this problem, there has been proposed a technique of using a valve or a sealing cap for sealing the reaction area at both ends of the reaction area inside the microfluidic chip, usually the inlet and outlet sides.

However, in the case of the valve technology, since a control unit capable of controlling the valve must be inserted and a physical or systemic technology that can control the valve is required, the structure and the procedure are complicated, which is disadvantageous for the process automation. Also, there is a drawback that leakage may occur due to the control unit that has been inserted or connected.

In addition, a sealing cap technology such as rubber and silicone sealing is a technique for forming a cap to fit the shapes of an inlet and an outlet of a fluid and pressing it with a physical support to prevent leakage. There is a disadvantage in that it is necessary to change the shape of the cap according to the shapes of the inlet and the outlet, and further physical support is required in order to prevent thermal expansion of the reaction fluid, which is disadvantageous in application of a process automatic system for controlling the physical support.

As a technique for improving the above disadvantages, a heat sealing-based sealing technique has been proposed in Japanese Patent Application Laid-Open No. 10-2016-0058302. The above patent document discloses a technique of sealing an inlet and an outlet by melting a plastic protruding type inlet and outlet at a high temperature/high pressure condition. However, additional equipment is required for high temperature/high pressure conditions and also there is a problem that there is a high possibility that the high temperature/high pressure condition may affect the fluid reagent and the surroundings.

Therefore, there is a growing need to develop a new method of sealing the inlet/outlet of a microfluidic chip, and also a new inlet/outlet structure optimized therefor, capable of providing semi-permanent sealing with simple equipment and configuration and capable of automating the process while solving the problem of bubbling in the reaction area of the microfluidic chip.

BRIEF SUMMARY OF THE INVENTION

Technical Problem

The present disclosure provides an inlet/outlet of a microfluidic chip optimized for sealing the inlet/outlet of the microfluidic chip using a UV curable sealing material.

In addition, the present disclosure provides a microfluidic chip having an inlet/outlet structure optimized for sealing the inlet/outlet of the microfluidic chip using a UV curable sealing material.

Furthermore, the present disclosure provides a method of sealing an inlet/outlet of a microfluidic chip using a UV curable sealing material.

Technical Solution

In an embodiment, an inlet/outlet of a microfluidic chip may include a fluid inlet part including an inlet through which a fluid flows in and a first opening coupled to an upper end of the inlet and receiving a sealing material and a fluid outlet part including an outlet through which the fluid flows out and a second opening coupled to an upper end of the outlet and receiving a sealing material. Here, the first opening and the second opening may be adjacent.

According to the present invention, the first opening and the second opening may be sealed at one time with one sealing material.

According to the present invention, a bottom surface of the first opening may be positioned higher than a bottom surface of the second opening.

According to the present invention, inner walls of the first opening and the second opening may have a concave curved surface.

According to the present invention, a bottom surface of the second opening may be positioned lower than an upper end of the outlet.

According to the present invention, at least one of the inlet and the outlet may have a funnel shape.

In an embodiment, a microfluidic chip may include a fluid inlet part including an inlet through which a fluid flows in and a first opening coupled to an upper end of the inlet and receiving a sealing material, a reaction area in which a predetermined reaction is performed on the fluid, and a fluid outlet part including an outlet through which the fluid flows out and a second opening coupled to an upper end of the outlet and receiving a sealing material. Here, the first opening and the second opening may be adjacent.

According to the present invention, the reaction may be a PCR reaction.

In an embodiment, a method of sealing an inlet/outlet of a microfluidic chip including a fluid inlet part including an inlet through which a fluid flows in and a first opening coupled to an upper end of the inlet and receiving a sealing material and a fluid outlet part including an outlet through which the fluid flows out and a second opening coupled to an upper end of the outlet and receiving a sealing material, wherein the first opening and the second opening are adjacent, the method may include introducing a fluid to the inlet, filling the first opening and the second opening with a sealing material by introducing the sealing material to the first opening, and curing the sealing material by irradiating an ultraviolet ray to the sealing material.

According to the present invention, the sealing material may be selected from a urethane acrylate, an epoxy acrylate, a polyester acrylate, a polybutadiene acrylate, a silicone acrylate, and an alkyl acrylate.

According to the present invention, the ultraviolet ray may have a wavelength of 320 to 400 nm, and the ultraviolet ray irradiation may be performed for 1 to 10 seconds.

Advantageous Effects

The present disclosure provides an inlet/outlet structure optimized for sealing an inlet and an outlet of a microfluidic chip using a UV curable material, thereby providing a semi-permanent sealing with less contamination of a fluid sample. The inlet and outlet of the microfluidic chip can be firmly sealed without using high-temperature/high-pressure conditions by using simple equipment.

Also, by using the microfluidic chip inlet/outlet structure and the sealing method according to the present disclosure, generation of bubbles is suppressed even if a predetermined reaction is performed on the microfluidic chip, thereby not only improving the accuracy and deviation of the reaction result and improving the reliability, but also it is possible to apply a fully automated system by eliminating the need for ancillary equipment such as physical supports and minimizing or eliminating manual operations.

The microfluidic chip according to the present disclosure can be utilized as various chips requiring sealing such as a biochip, a diagnostic chip, and a microchip.

DESCRIPTION OF THE DRAWINGS

Brief description on each drawing figure will be provided so that the drawing figures referenced in the detailed description may be more sufficiently understood.

DETAILED DESCRIPTION OF THE INVENTION

Figure 1:
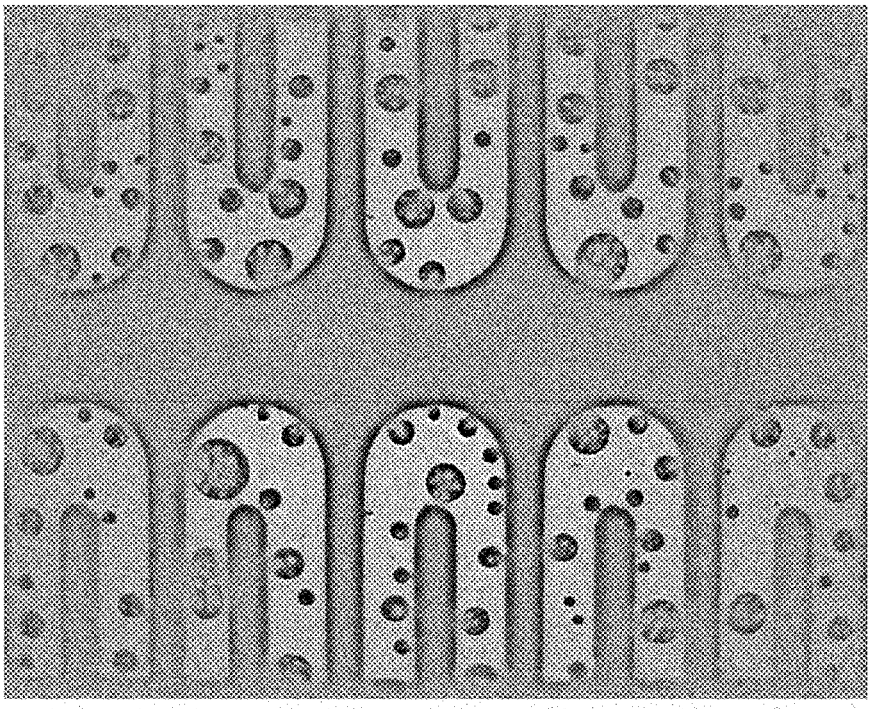
FIG. 1 shows PCR reaction results of a conventional PCR chip.
Figure 1:
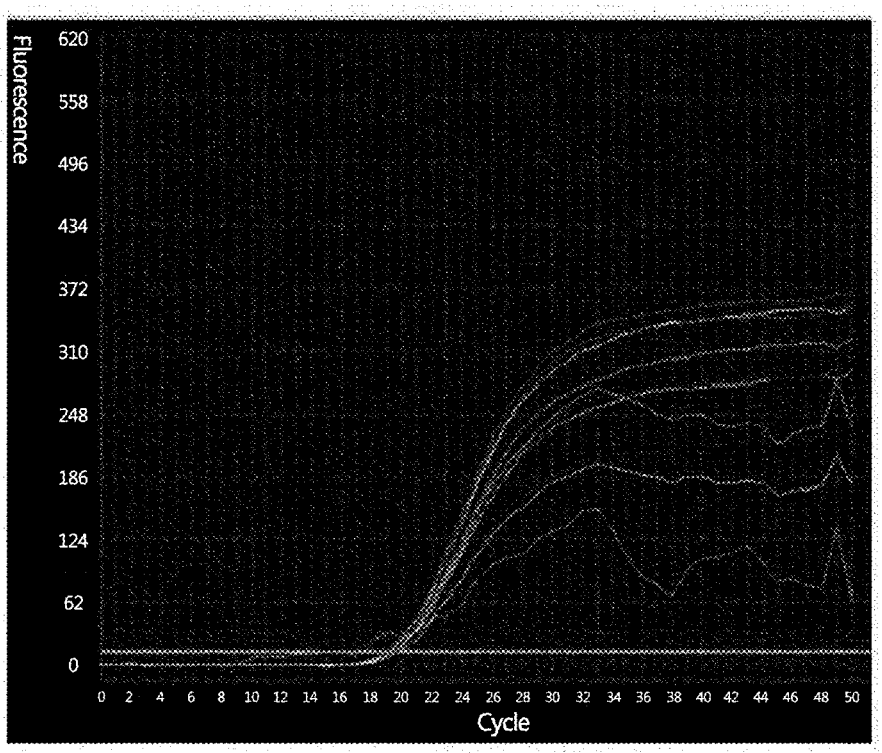

Hereinafter, example embodiments will be described with reference to the accompanying drawings; however, for reference numerals, with respect to the same elements, even though they may be displayed in different drawings, such elements use same reference numerals as much as possible. Also, in explaining the example embodiments, detailed description on known elements or functions will be omitted if it is determined that such description will interfere with understanding of the embodiments. In addition, the example embodiments may be embodied in different forms and should not be construed as limited to the embodiments set forth herein but may be modified and variously implemented by those skilled in the art.

In the drawing figures, dimensions may be exaggerated for clarity of illustration. It will be understood that when an element is referred to as being "between" two elements, it can be the only element between the two elements, or one or more intervening elements may also be present. It will be understood that when a part includes or has an element, it does not mean that other elements are excluded but that other elements may be further included. Also, in explaining elements, terms like "first", "second", "A", "B", "(a)", "(b)", etc. may be used. However, such terms are used to distinguish one from the others only and they do not affect the essence, nature, sequence, order, etc.

Figure 2:
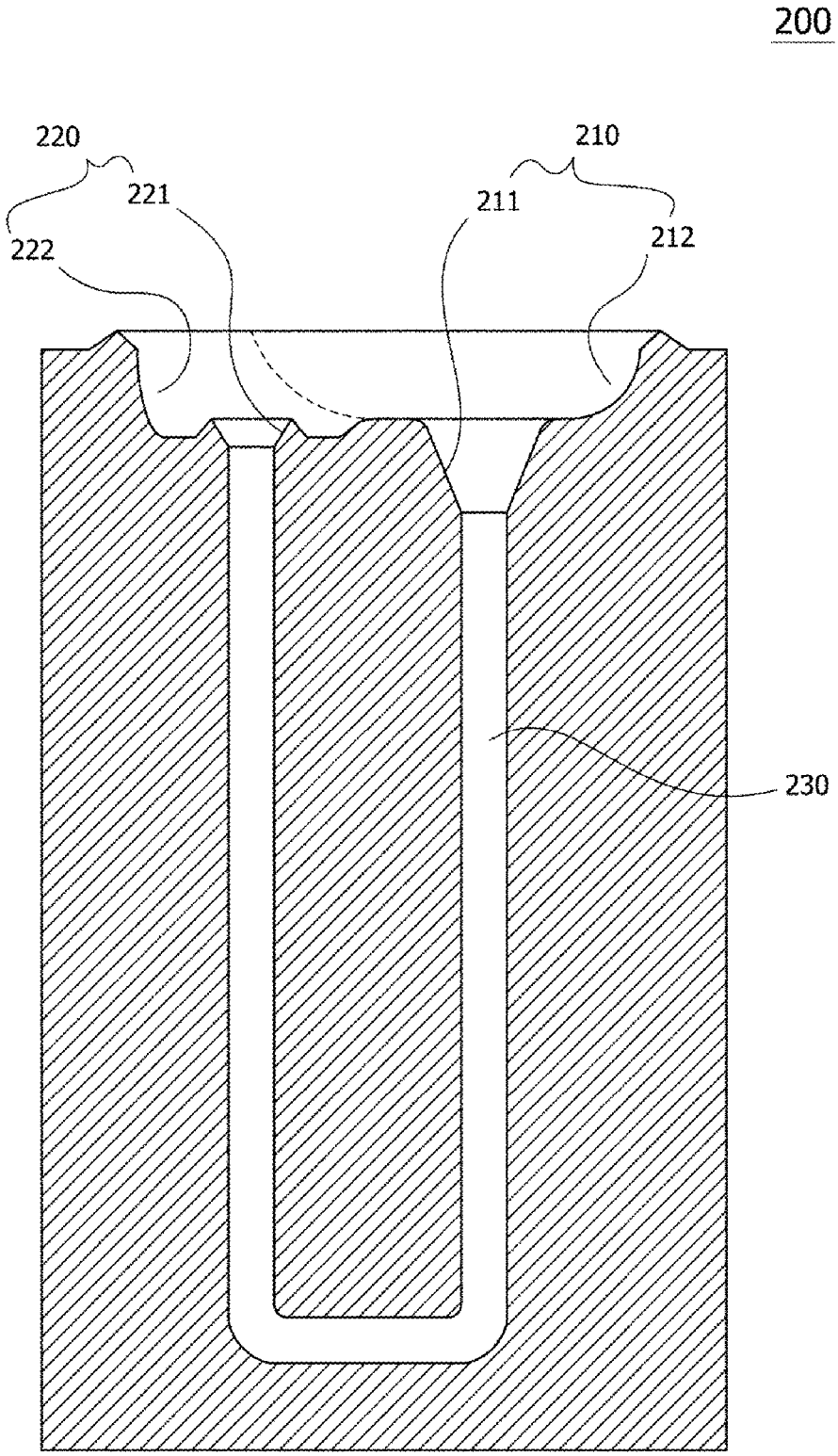
FIG. 2 illustrates a microfluidic chip according to an embodiment.

FIG. 2 illustrates a microfluidic chip 200 according to an embodiment. The microfluidic chip 200 according to an embodiment may include a fluid inlet part 210 through which a fluid flows in, a reaction area 230 in which a predetermined reaction is performed on the fluid and a fluid outlet part 220 through which the fluid flows out or is discharged.

In the present disclosure, the fluid introduced through the fluid inlet part 210 may undergo a predetermined reaction in a reaction area 230 and thereafter may flow out through the fluid outlet part 220. Here, the reaction may be a PCR reaction, but this is illustrative only; various reactions may occur according to aspects of embodiments of the present invention.

In addition, the shape or the structure of the microfluidic chip 200 shown in FIG. 2 is illustrative only; a microfluidic chip of various shapes and structures can be used according to implementation situations to which the present invention is applied. Also, the microfluidic chip according to the present disclosure can be utilized as various chips requiring sealing such as a biochip, a diagnostic chip, and a microchip.

Hereinafter, components of the microfluidic chip 200 according to an embodiment will be described in more detail.

Figure 3:
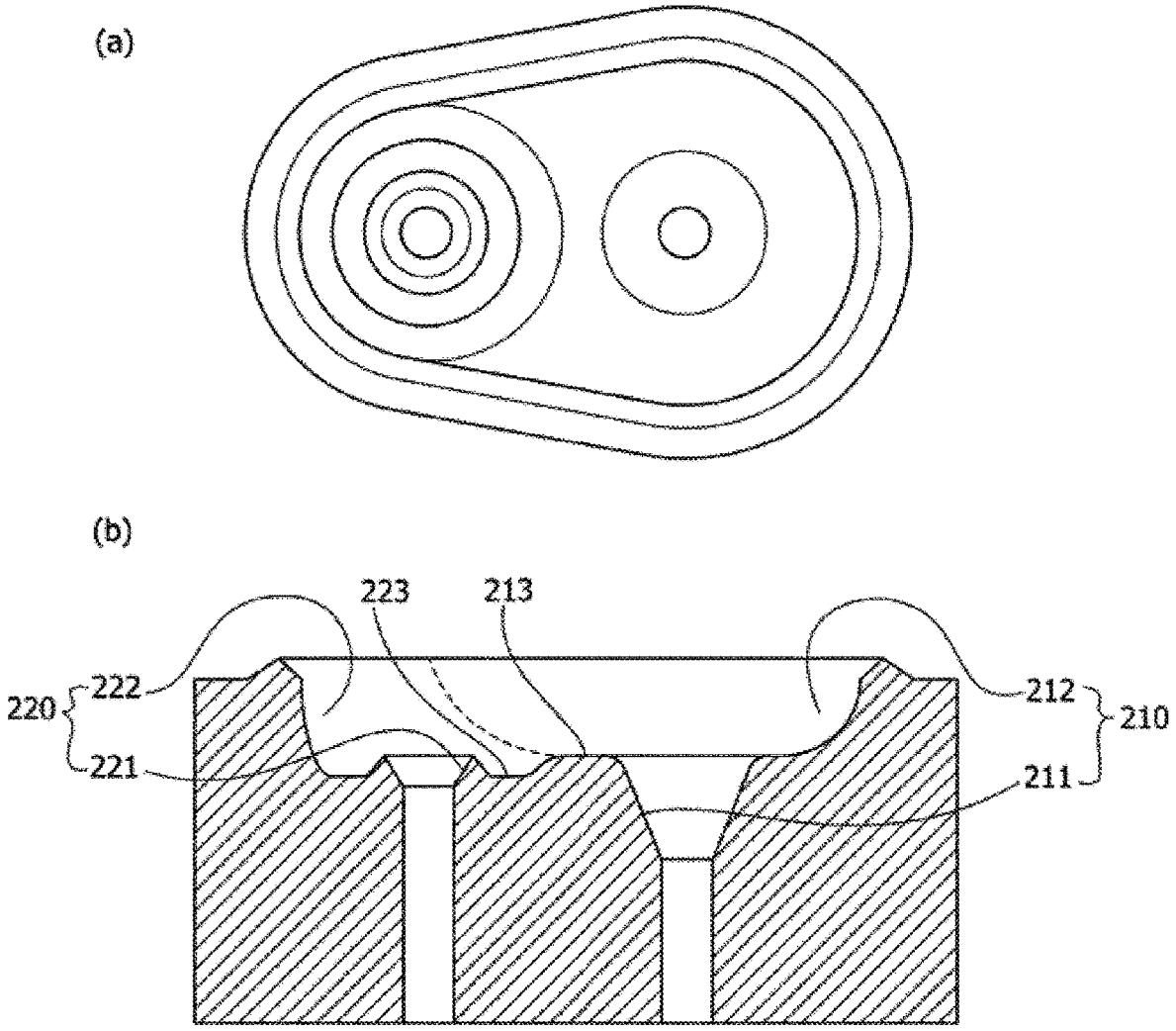
FIG. 3 shows a plan view (a) and a sectional view (b) of an inlet/outlet structure of a microfluidic chip according to an embodiment.

FIG. 3 is a plan view FIG. 3A and a cross-sectional view FIG. 3B of an inlet/outlet of a microfluidic chip 200 according to an embodiment. The inlet/outlet of the microfluidic chip 200 may include a fluid inlet part 210 having an inlet 211 through which a fluid 310 flows in and a first opening 212 connected to an upper end of the inlet 211; and a fluid outlet 220 having an outlet 221 through which the fluid flows out and a second opening 222 connected to an upper end of the outlet 221. Here, the first opening 212 and the second opening 222 may be formed adjacent to each other.

In the present disclosure, the first opening 212 may be connected to the upper end of the inlet 211 through which the fluid 310 flows in and may extend more widely than a diameter of the upper end of the inlet 211, and the second opening 222 may be connected to the upper end of the outlet part 221 through which the fluid 310 flows out and may extend more widely than a diameter of the upper end of the outlet part 221.

In the present disclosure, the first opening 212 and the second opening 222 may be adjacent to each other. In the present disclosure, the term "adjacent" means that the two elements are in close contact with each other thereby forming a boundary, or that the two elements partially overlap each other.

More specifically, as shown in FIG. 3A, the first opening 212 and the second opening may form a connected opening by having their respective open ends be in close contact with each other (thereby forming a boundary) or partially overlap each other. As will be described in detail below, the outlet 221 of the microfluidic chip may be sealed by introducing the sealing material 320 into the first opening 212 and curing the sealing material 320 by ultraviolet rays. At this time, since the second opening 222 is formed adjacent to the first opening 212, the sealing material 320 introduced into the first opening 212 may flow in up to the second opening 222, and as a result, the first opening 212 and the second opening 222 may be sealed at one time.

In the case of the conventional inlet/outlet structure, each of the inlet/outlet is formed separately. Accordingly, if one side is sealed, the pressure from the sealing is transferred to the opening on the other side through the fine channel, and thus there is a phenomenon that the flow of the internal liquid changes or the liquid leaks to the outside. As a result, bubbles or the frequency of leaks in the fluid channel tends to increase. However, in the present disclosure, two openings are sealed at one time, and thus the problem is greatly reduced.

In an embodiment, when the first opening 212 and the second opening 222 are formed adjacent to each other, a bottom surface 213 of the first opening 212 may be positioned higher than a bottom 223 of the second opening 222. The "bottom surface" of the first opening 212 or the second opening 222 may mean the lowest part of the inner wall surrounding the opening. According to an aspect of embodiment, the bottom surface may be of a planar form of a certain area. According to another aspect of embodiment, the bottom surface may be in the form of a very narrow surface and may be recognized as a line or a point even.

In the present disclosure, the bottom surface 213 of the first opening 212 may be positioned higher than the bottom surface 223 of the second opening 222, the fluid 310 may not excessively flow into the inlet 211, or due to a force by the sealing material for pressing the inlet 211, the fluid 310 that flows out of the outlet 221 may be stored in the form of droplets on the bottom surface of the second opening 222 and may not go/spill over to the first opening 212. As the fluid 310 that is thus discharged is prevented from going/spilling over to the first opening 212, the first opening 212 may be more firmly sealed with the sealing material 320 without being contaminated by the fluid.

In the present disclosure, the first opening 212 may be connected to the upper end of the inlet 211 and have a shape that is wider than the diameter of the upper end of the inlet 211. Here, the inner wall of the first opening 212 does not simply expand in an inclined form, but it may expanded to the shape of a curved surface.

The conventional inlet/outlet structures use a pipette to inject fluid. However, if the fluid on the side or at the end of the pipette mistakenly touches a peripheral part of the inlet, there occurs a leakage of fluid due to non-contact of the sealing material, and due to such leakage, when the sealing material is applied and sealed thereafter, defective sealing occurs. Accordingly, fluid leakage occurs or the frequency of occurrence of bubbles inside the chip is increased, and therefore analysis reliability is deteriorated. The fluid inlet part 210 of the microfluidic chip 200 according to the present disclosure includes a first opening 212 that extends in the shape of a concave curved surface at the upper end of the inlet 211 where fluid is injected, and thus the possibility of poor sealing due to pipetting mistakes can be greatly reduced. In the present disclosure, the defective sealing may mean that a gap through which leakage can occur is found, or when leakage occurs in the initial cycle in the course of analyzing reactions such as PCR reactions.

Also, in the present disclosure, the second opening 222 may be connected to the upper end of the outlet 221 and have and have a shape that is wider than the diameter of the upper end of the inlet 211. Here, the bottom surface 223 of the second opening 222 may be positioned lower than the upper end of the outlet 221. As shown in FIG. 3A, the upper end of the outlet 221 may be connected to the second opening 222 in a protruding form from the center of the second opening 222, the bottom surface 223 of the second opening 222 may be positioned lower than the upper end of the outlet 221.

During the inflow of the fluid 310 into the inlet 211 of the microfluidic chip, the fluid 310 may flow out through the outlet 221 due to injection of an excessive amount of the fluid, or during the introduction of the sealing material 320, the sealing material 320 may press the fluid 310 that flows into the inlet 211 and thus cause a portion of the fluid 310 to flow out. Here, the bottom surface 223 of the second opening 222 may be positioned lower than the upper end of the outlet 221, and therefore the overflowing fluid 310 does not spread widely to the second opening 222 but may be collected on the bottom surface 223 of the second opening 222 in the form of the droplets. Thereafter, as the introduced sealing material 320 may cover the fluid 310 gathered in the droplet form, achieving more rigid sealing.

In addition, the inner wall of the second opening 222 may be expanded into a concave curved shape. Here, by setting the size of the second opening 222 and the size of the first opening 212 to be different from each other, or by setting the concave degree of the inner wall differently, such that the fluid inlet part 210 and the fluid outlet part 220 may be easily recognized by the naked eye. Accordingly, it is possible to prevent fluid sample from flowing into the fluid outlet portion 220 by mistake.

Meanwhile, in an embodiment, the inlet 211 and the outlet 221 may be configured to have a funnel shape. By configuring the inlet 211 and outlet 221 to have a funnel shape, it is possible to more easily inject the fluid 310 into the inlet 211 and prevent the fluid 310 from leaking to a peripheral part. Also, as the fluid that comes up to the outlet 221 via the reaction area 230 is slowed down at the upper end of the outlet 221 in terms of its speed of surface coming up, more precise fluid injection can be achieved.

The inlet/outlet structure of the microfluidic chip 200 according to the present disclosure may provide a sealing structure that is most optimized and robust when sealing the inlet/outlet of the microfluidic chip by using the UV curable sealing material. By using such sealing, it is possible to prevent the reliability of the reaction result from being hindered as a result of loss of the fluid that is injected into the microfluidic chip in the reaction area or before and after the reaction area, or as a result of the bubbles. For example but without any limitation thereto, when the PCR reaction is carried out in the reaction area, reliable CT and fluorescence signal value of the PCR can be obtained by preventing bubbles from forming.

Hereinafter, a method of sealing the inlet/outlet of the microfluidic chip 200 according to an embodiment will be described in detail.

Figure 4:
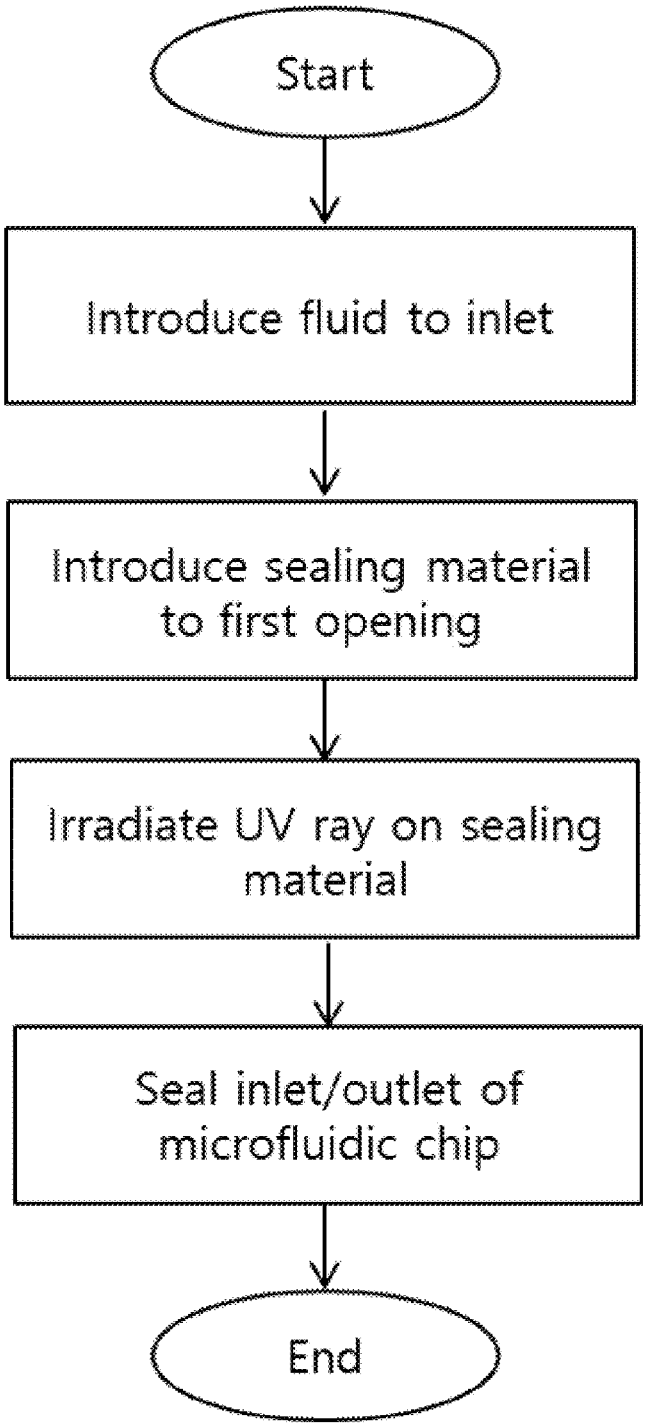
FIG. 4 is a process diagram illustrating a method of sealing an inlet/outlet of a microfluidic chip according to an embodiment.

As shown in FIG. 4, the method of sealing the inlet/outlet of the microfluidic chip 200 according to an embodiment may include flowing a fluid 310 into the inlet 211, filling the first opening 212 and the second opening 222 by introducing the sealing material 320 into the first opening 212, and irradiating ultraviolet rays to the sealing material 320 to cure the sealing material 320.

In the present disclosure, the sealing material 210 may be made of a UV curable material. By sealing the inlet/outlet of the microfluidic chip 200 using the UV curable material, semi-permanent sealing of the microfluidic chip is possible, and the sealing process does not require extreme conditions such as high temperature/high pressure, so that the influence on the reaction area is extremely small. In addition, the sealing process can be carried out with simple equipment such as a fluid injection equipment which is not bulky; and there is no need for an auxiliary device that can be used as a physical support, so that the procedure to be performed manually is largely omitted, and thus it is easy to apply to an automation system.

In an embodiment, the sealing material 320 may be selected from urethane acrylate, epoxy acrylate, polyester acrylate, polybutadiene acrylate, silicone acrylate and alkyl acrylate sealants. In particular, a urethane acrylate oligomer may be used.

In the present disclosure, the ultraviolet ray irradiation may be performed by selecting a suitable condition for curing the sealing material depending on the type of the sealing material. For example, the ultraviolet ray may be irradiated at a wavelength of 320 to 400 nm corresponding to the UV-A region for 1 to 10 seconds at room temperature so that the sealing material can be completely cured.

Hereinafter, with reference to FIG. 5, the sealing method of the inlet/outlet of the microfluidic chip according to an embodiment will be described in more detail.

Figure 5A:
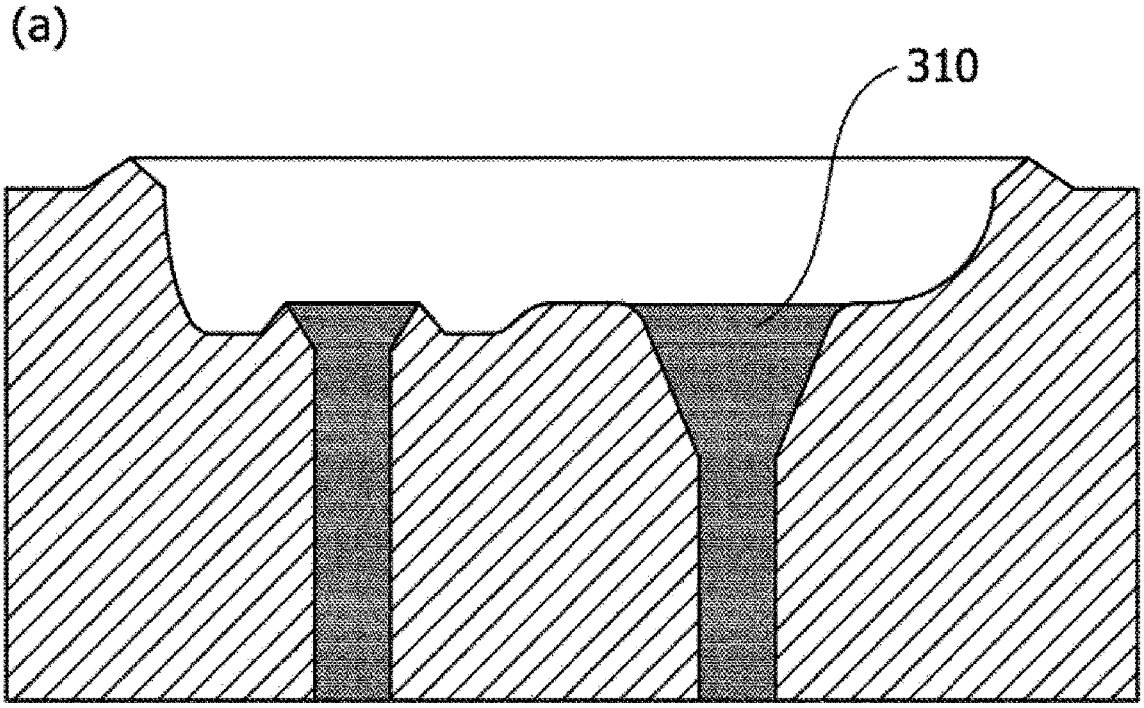
FIG. 5A-5D illustrate a process of sealing an inlet and an outlet of a microfluidic chip according to an embodiment.

In the step of introducing the fluid 310 into the inlet 211, the fluid 310 on which a predetermined reaction may be performed may be selected and introduced using a device such as a pipette. The reaction may be, but is not limited to, a PCR reaction. Although the inflow may be performed manually using a device such as a pipette, according to an embodiment, the fluid 310 may be introduced into the inlet 211 by a predetermined amount by an automated process by applying the pre-process automation. As shown in FIG. 5A, the inflow may be performed to such an extent that the fluid 310 flows into the reaction area 230 through the inlet 211 and fills the reaction area 230 up completely and then is filled up to the upper end of the outlet 221.

Figure 5B:
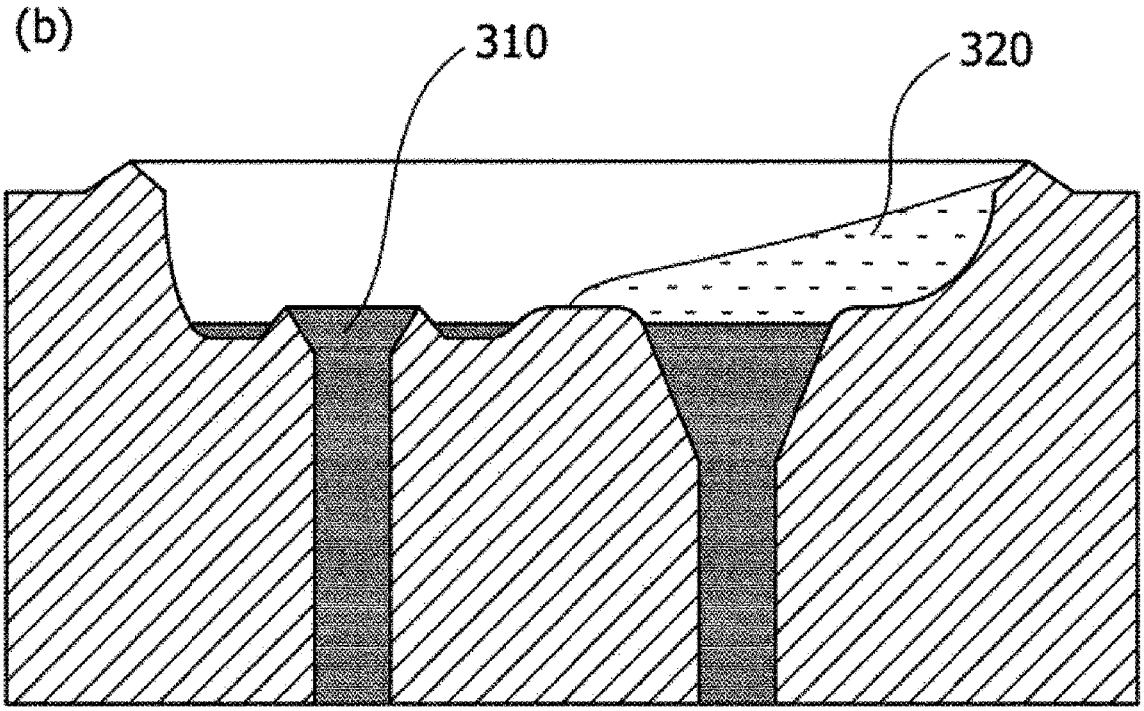
Figure 5C:
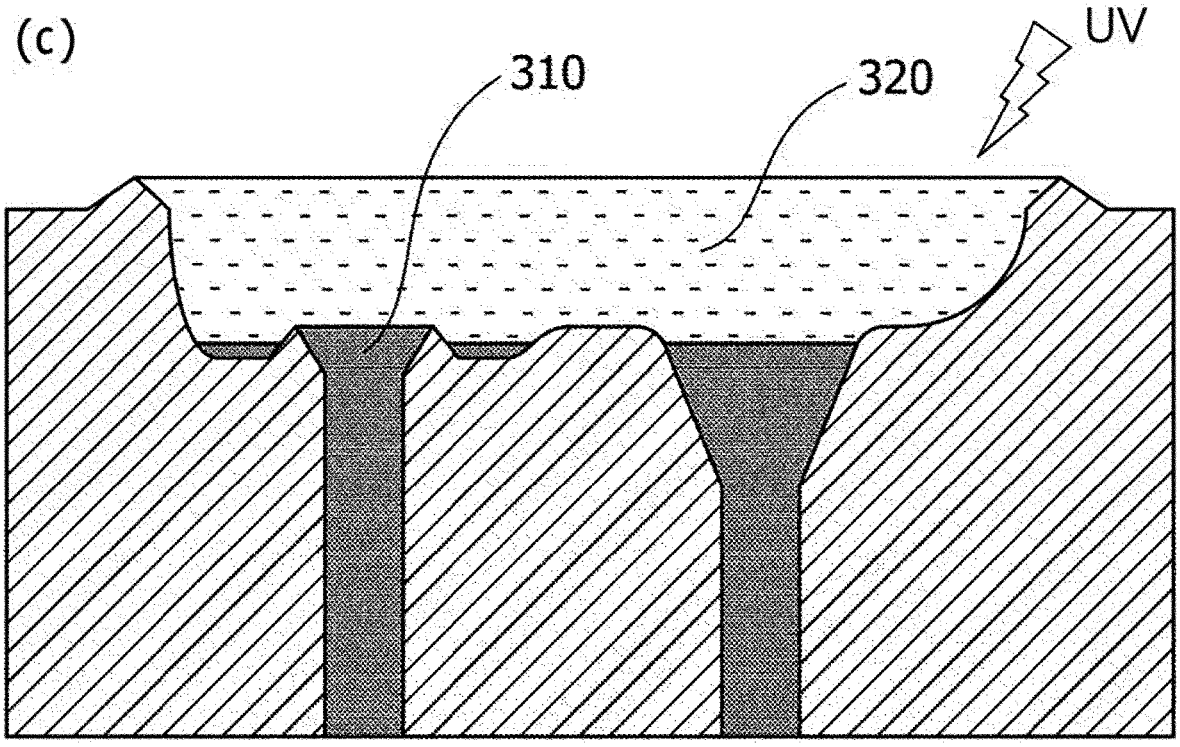
Figure 5D:
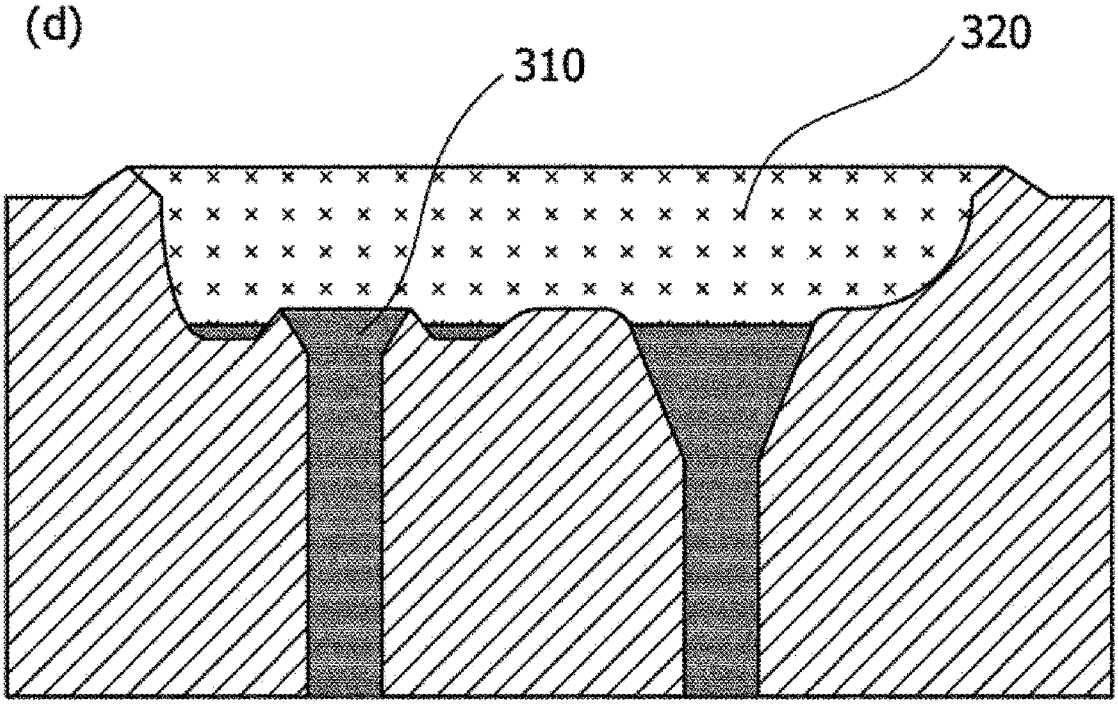

After the fluid 310 is introduced, as shown in FIG. 5B, the UV curable sealing material 320 as described above may be introduced through the first opening 212. When the sealing material 320 is introduced through the first opening 212, the fluid 310 filled in the inlet 211 may be pressed while filling the first opening. At this time, the pressurized fluid 310 can be partially discharged through the outlet 212. A part of the outflowed fluid 310 may be placed in the form of a droplet on the bottom surface 223 of the second opening 222 and the sealing material 320 may be further introduced to fill the second opening 222, and as the second opening 222 is filled, it may be completely covered by the sealing material 320. The sealing material 320 may be introduced until the first opening portion 212 and the second opening portion 222 are filled all the way as shown in FIG. 5C. Thereafter, the sealing material 320 may be cured by irradiating it with the ultraviolet ray selected to be suitable for the type of the UV curable sealing material 320, so that the inlet and outlet of the microfluidic chip 200 may be sealed The inlet/outlet of the microfluidic chip 200 that has been sealed by the above-described process are shown in FIG. 5D. As illustrated in FIG. 5D, the fluid 310 introduced into the inlet 211 is pressurized by the sealing material 320 so that the surface of the fluid 310 is sealed in a state slightly lower than the uppermost end of the inlet 211. It can also be seen that the sealing material 320 is cured in such a state that a small amount of the fluid 310 flowing out to the outlet 221 by the above pressing is located on the bottom surface of the second opening 222 and the sealing material 320 covers a top thereof.

As described above, an optimal implementation example has been disclosed in the drawings and specification. Although acts in a particular order are shown in the figures, it should not be understood that these acts are performed in the specific order shown, or in a sequential order, or that all illustrated acts need to be performed to achieve the desired result.

In addition, although specific terms are used, they are used for the purpose of describing the present invention only and are not used to limit the scope of the present invention described in the claims. Therefore, those skilled in the art will appreciate that various modifications and equivalent embodiments are possible without departing from the scope of the present invention. Accordingly, the true scope of the present invention should be determined by the technical idea or concept of the claims.

EXAMPLES

Hereinafter, the present invention will be described in more detail with reference to examples. It is to be understood, however, that these examples are illustrative of some experimental methods and compositions in order to illustrate the present invention, and the scope of the present invention is not limited to these examples.

Example 1: PCR Performance Evaluation of Microfluidic Chip According to an Embodiment PCR was carried out using a microfluidic chip having an inlet/outlet structure according to the present disclosure.

The MERS COV-SPIKE detection kit (nano-biosys) was used as the PCR sample, the microfluidic chip was applied to G2-4 (nano-biosys) which is a PCR apparatus, the sample was introduced into the inlet of the microfluid chip until being filled up to the upper end of the outlet, and thereafter, DW8419 (DawonSchem) was poured as a sealing material so that the sealing material was filled from the fluid inlet part and finally filled up to the fluid outflow part.

The sealing material was irradiated with ultraviolet ray having a peak wavelength of 360 nm at about 600 mJ/cm$^2$ for about 5 seconds to complete the sealing of the microfluidic chip.

The defective rate test, the internal bubble test of the fluid chip and the PCR performance test were performed for the sealed PCR chip. The test was performed using a G2-4 instrument capable of real-time PCR measurement, and each item was analyzed by imaging each cycle of the PCR in real time and grasping nine states of the sample.

Specifically, the defective rate test was defined as the failure of the sealing in the case where the leakage was confirmed from the experimental image in the PCR initial cycle, and the ratio of defective samples to all 96 samples was calculated as a defective rate. In the analysis of the internal bubble of the fluid chip, the ratio of the total area width of the bubble to the width of the entire channel was calculated by measuring the bubble area in the final PCR image during the PCR analysis. For PCR performance, the percentage of variation coefficient (CV) of the CT (cycle threshold) value of the diagnostic reagent measured by image analysis was confirmed. In the PCR reaction, the time point at which the amplification speed change rate of the amplification curve is the largest is set as the CT value. In theory, when the same reagent is used, the CT value must be consistent since the amplification of the reagent is constant. However, in the case of sealing failure, the CT value was distorted and the PCR performance was measured by calculating the deviation as CV.

Figure 6:
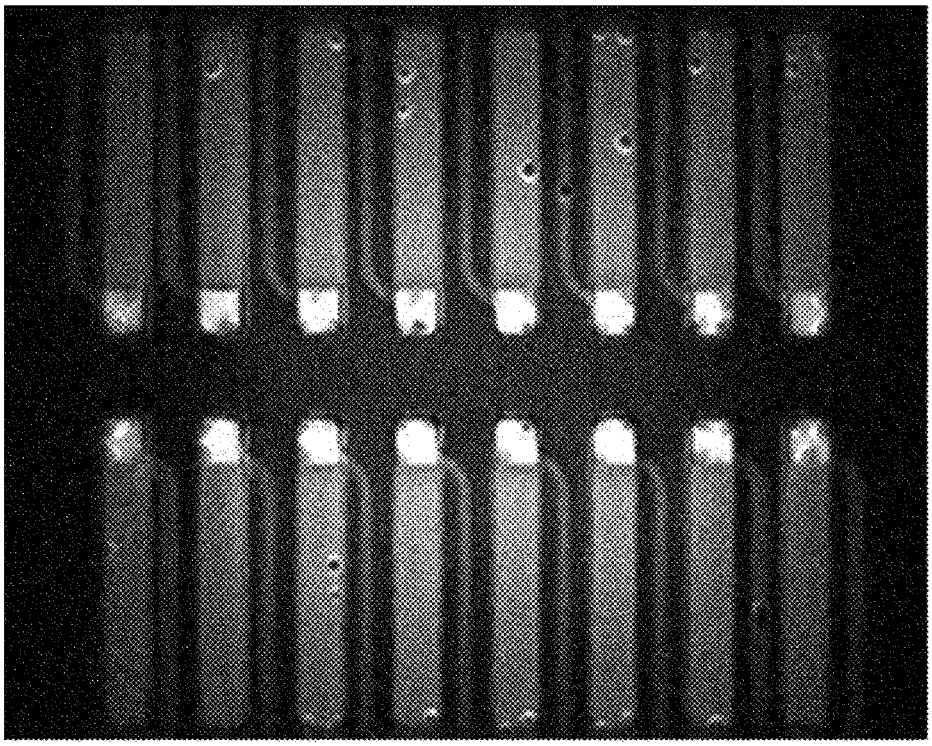
FIG. 6 shows an image (a) and a detection result (b) of a microfluidic chip according to an embodiment.
Figure 6:
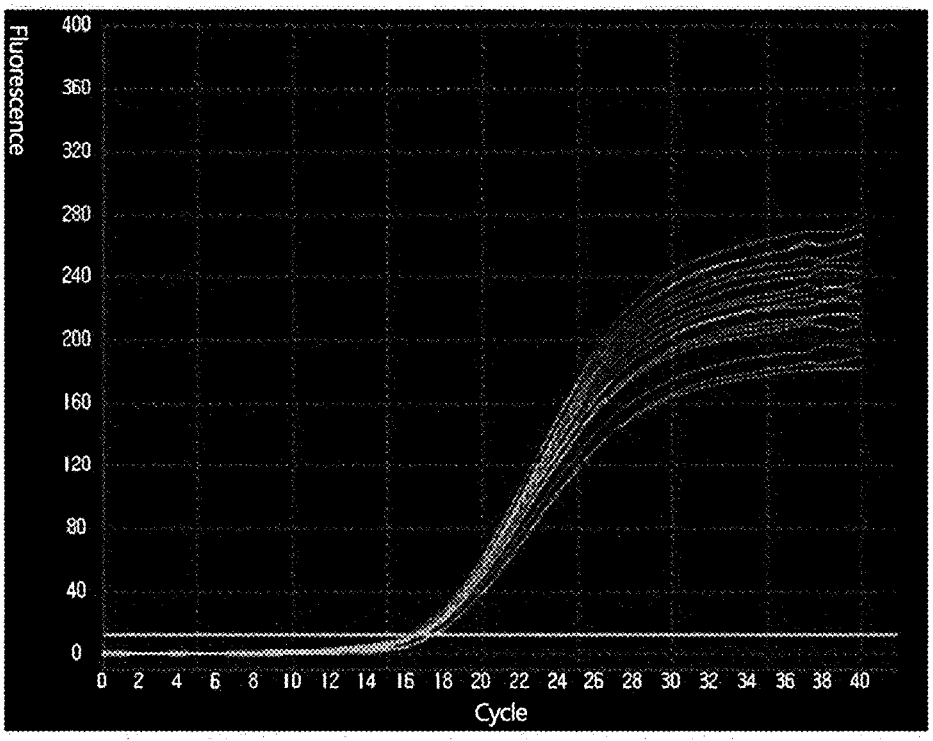

The results of Example 1 are shown in Table 1 below, and the image of PCR 45 cycle and data obtained by plotting images of the detection results according to each cycle are shown in FIGS. 6A and 6B, respectively.

Figure 7:
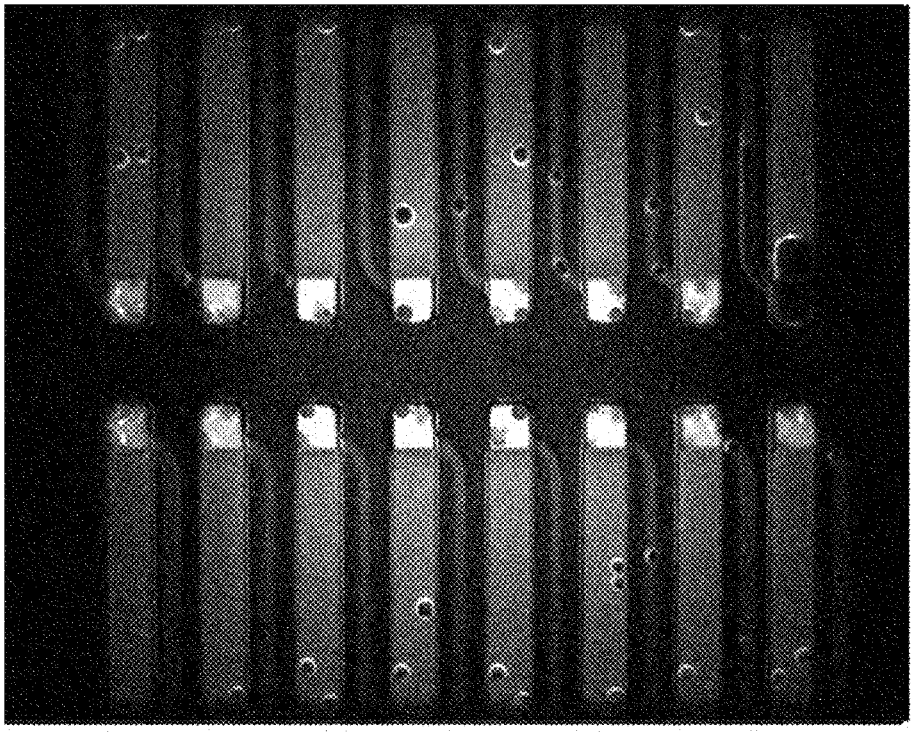
FIG. 7 shows an image (a) and a detection result (b) of a microfluidic chip according to a comparative example.
Figure 7:
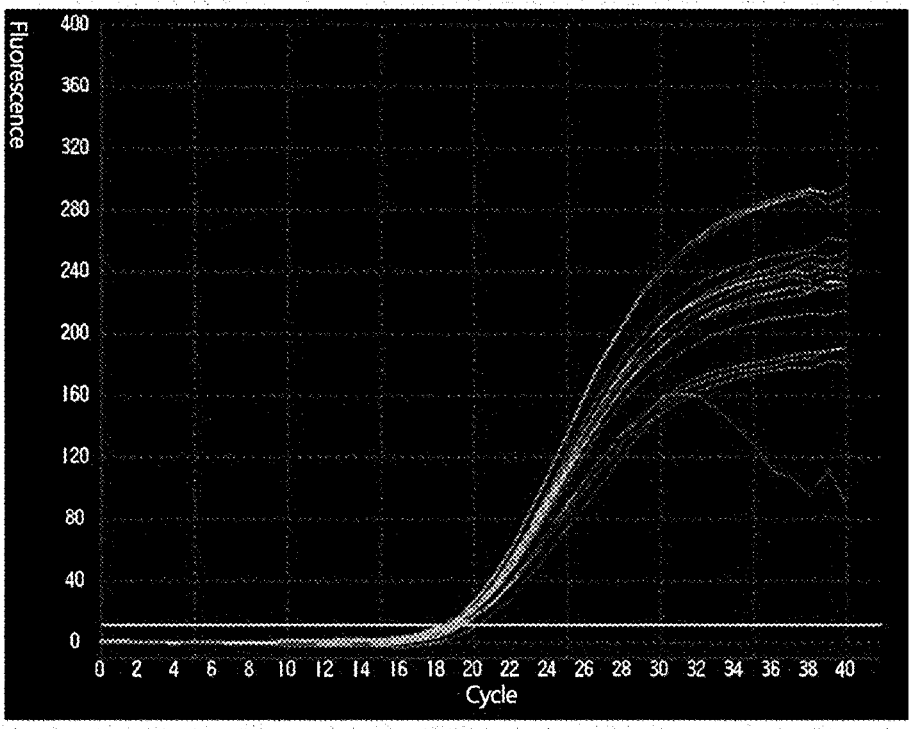

Comparative Example 1: Evaluation of PCR Performance of a Microfluidic Chip Having a Conventional Inlet/Outlet Structure By using a microfluidic chip having an inlet and an outlet structure having an inlet and an outlet, adjacent to each other, in the form of a funnel without the inlet and outlet structures of the present disclosure, the defective rate of the PCR chip, the internal bubble of the fluid chip and the PCR performance were tested in the same method as Example 1. The results are shown in Table 1 below, and the image from PCR 45 cycle and the data obtained by plotting images of the detection results according to each cycle are shown in FIGS. 7A and 7B, respectively.

TABLE 1

| | Defect rate | Internal bubble | PCR performance (CV of CT value) |
|---|---|---|---|
| Example 1 | 1.04% | 0.86% | 2.11% |
| Comparative example 1 | 6.25% | 2.59% | 3.01% |

As can be seen from Table 1 above, it was confirmed that the sealing structure using the inlet and outlet structure of the microfluidic chip of the present disclosure showed a significantly lower defective rate than the sealing structure of the comparative example, and the inner bubble of the fluid chip was also significantly reduced. In addition, the percentage of the coefficient of variation (CV) with respect to the CT value of the sample of Example 1 is much lower than the CV value of the comparative example. When the inlet and outlet structures of the microfluidic chip of the present disclosure are used, the defective rate of sealing was significantly lower.

Such result can be compared even with the microfluidic chip image of the example and the comparative example. As can be seen from FIGS. 6A and 7A, bubbles were significantly less in the case of the microfluidic chip of the embodiment using the inlet and outlet structure of the present disclosure than in the case of the microfluidic chip of the comparative example. In addition, such result affects even the PCR detection result. As can be seen from FIG. 6B, the microfluidic chip of the embodiment shows a stable and reliable PCR detection result graph; however, in the case of FIG. 7B, in the amplification curve of fluorescent color, one curve shows a tendency to decrease downward unlike the overall tendency. This phenomenon is a typical example of a distortion phenomenon caused by defective sealing, and it can be confirmed that sealing is relatively incomplete at the inlet and outlet of the microfluidic chip of the comparative example.

The invention claimed is:

1. An inlet/outlet of a microfluidic chip, comprising:
- a fluid inlet part including an inlet through which a fluid flows in and a first opening coupled to an upper end of the inlet and receiving a sealing material; and
- a fluid outlet part including an outlet through which the fluid flows out and a second opening coupled to an upper end of the outlet and receiving a sealing material, wherein the first opening and the second opening are adjacent.

2. The inlet/outlet of claim 1, wherein the first opening and the second opening are sealed at one time with one sealing material.

3. The inlet/outlet of claim 1, wherein a bottom surface of the first opening is positioned higher than a bottom surface of the second opening.

4. The inlet/outlet of claim 1, wherein inner walls of the first opening and the second opening have a concave curved surface.

5. The inlet/outlet of claim 1, wherein a bottom surface of the second opening is positioned lower than an upper end of the outlet.

6. The inlet/outlet of claim 1, wherein at least one of the inlet and the outlet has a funnel shape.

7. A microfluidic chip, comprising:
- a fluid inlet part including an inlet through which a fluid flows in and a first opening coupled to an upper end of the inlet and receiving a sealing material;
- a reaction area in which a predetermined reaction is performed on the fluid; and
- a fluid outlet part including an outlet through which the fluid flows out and a second opening coupled to an upper end of the outlet and receiving a sealing material, wherein the first opening and the second opening are adjacent.

8. The microfluidic chip of claim 7, wherein the first opening and the second opening are sealed at one time with one sealing material.

9. The microfluidic chip of claim 7, wherein a bottom surface of the first opening is positioned higher than a bottom surface of the second opening.

10. The microfluidic chip of claim 7, wherein inner walls of the first opening and the second opening have a concave curved surface.

11. The microfluidic chip of claim 7, wherein a bottom surface of the second opening is positioned lower than an upper end of the outlet.

12. The microfluidic chip of claim 7, wherein at least one of the inlet and the outlet has a funnel shape.

13. The microfluidic chip of claim 7, wherein the reaction is a PCR reaction.

14. A method of sealing an inlet/outlet of a microfluidic chip including a fluid inlet part including an inlet through which a fluid flows in and a first opening coupled to an upper end of the inlet and receiving a sealing material and a fluid outlet part including an outlet through which the fluid flows out and a second opening coupled to an upper end of the outlet and receiving a sealing material, wherein the first opening and the second opening are adjacent, the method comprising:

introducing a fluid to the inlet;

filling the first opening and the second opening with a sealing material by introducing the sealing material to the first opening; and curing the sealing material by irradiating an ultraviolet ray to the sealing material.

15. The method of claim 14, wherein the sealing material is selected from a urethane acrylate, an epoxy acrylate, a polyester acrylate, a polybutadiene acrylate, a silicone acrylate, and an alkyl acrylate.

16. The method of claim 14, wherein the ultraviolet ray has a wavelength of 320 to 400 nm.

17. The method of claim 14, wherein the ultraviolet ray irradiation is performed for 1 to 10 seconds.

18. The method of claim 14, wherein the ultraviolet ray irradiation is performed in a range that does not affect the fluid.

* * * * *